US010492554B2

(12) United States Patent
Sears

(10) Patent No.: US 10,492,554 B2
(45) Date of Patent: Dec. 3, 2019

(54) WEARABLE DEVICE

(71) Applicant: Robin Sears, Dublin, OH (US)

(72) Inventor: Robin Sears, Dublin, OH (US)

( * ) Notice: Subject to any disclaimer, the term of this patent is extended or adjusted under 35 U.S.C. 154(b) by 162 days.

(21) Appl. No.: 15/695,053

(22) Filed: Sep. 5, 2017

(65) Prior Publication Data

US 2018/0177257 A1 Jun. 28, 2018

Related U.S. Application Data

(60) Provisional application No. 62/437,721, filed on Dec. 22, 2016.

(51) Int. Cl.
*A42B 1/24* (2006.01)
*A44B 1/18* (2006.01)

(52) U.S. Cl.
CPC ..... *A42B 1/247* (2013.01); *A42B 1/242* (2013.01); *A42B 1/248* (2013.01); *A42B 1/24* (2013.01); *A44B 1/18* (2013.01)

(58) Field of Classification Search
CPC ..... A42B 1/247; A42B 1/148; A42B 1/24; A45F 2200/0575; A45F 2200/0541
USPC ..... 2/209.13; 351/156
See application file for complete search history.

(56) References Cited

U.S. PATENT DOCUMENTS 4,991,236 A 2/1991 Pritchett
5,170,509 A * 12/1992 Leopold ..... A41G 5/0093 132/273
5,418,981 A * 5/1995 Miner ..... A42B 1/248 2/181
5,632,047 A * 5/1997 Van Den Heuvel ... A42B 1/248 2/171.4
6,189,154 B1 * 2/2001 Ducharme ..... A45C 13/02 2/247
7,325,255 B2 2/2008 Cunliffe
7,325,920 B1 2/2008 Gelfuso
D582,131 S 12/2008 French, III et al.
7,562,977 B1 * 7/2009 Heaton ..... A42B 1/247 351/155
7,761,928 B2 7/2010 Wang
7,866,813 B2 1/2011 Anhalt
RE43,407 E 5/2012 Duffy et al.
8,316,467 B2 11/2012 Foust et al.
8,545,041 B2 10/2013 Brown
8,549,667 B1 * 10/2013 Fuller ..... A41D 27/20 2/160
8,757,030 B2 6/2014 Ochs
9,380,258 B2 6/2016 Sandy
2006/0117462 A1 6/2006 Wysopal
2008/0141438 A1 * 6/2008 Reitz ..... A41G 7/00 2/206
2010/0313329 A1 * 12/2010 Haynes ..... A41D 13/0012 2/102
2014/0310853 A1 10/2014 Miles
(Continued)

*Primary Examiner* — Timothy K Trieu
(74) *Attorney, Agent, or Firm* — Benesch, Friedlander, Coplan & Aronoff LLP

(57) ABSTRACT

An apparatus is configured for use with a garment having an opening. The apparatus comprises a wearable device with fasteners. The device has utility separately from the garment. The fasteners are attached to the device separately form the garment, and are arranged to fasten the device to the garment at multiple locations spaced apart about a periphery of the opening to support the device in a mounted position over the opening.

21 Claims, 8 Drawing Sheets

(56) References Cited

U.S. PATENT DOCUMENTS

| | | | |
|---|---|---|---|
| 2015/0029746 | A1 | 1/2015 | Campbell |
| 2015/0059054 | A1 | 3/2015 | Peterson |
| 2016/0242482 | A1 | 8/2016 | Cabral |
| 2017/0181255 | A1 | 6/2017 | Jeremy et al. |

* cited by examiner

WEARABLE DEVICE

RELATED APPLICATIONS

This application claims priority of provisional U.S. Patent Application 62/437,721, filed Dec. 22, 2016, which is incorporated by reference.

TECHNICAL FIELD

This technology relates to a wearable device having utility separately from a garment upon which the device is worn.

BACKGROUND

A device having utility separately from a garment is sometimes mounted on the garment.

SUMMARY

An apparatus is configured for use with a garment having an opening. The apparatus comprises a wearable device with fasteners. The device has utility separately from the garment. The fasteners are attached to the device separately from the garment, and are arranged to fasten the device to the garment at multiple locations spaced apart about a periphery of the opening to support the device in a mounted position over the opening.

In a given example, the garment is a hat, and the opening is a cutout at the rear of the hat. An inner edge portion of the hat has a shape reaching around the cutout. An adjustment strap reaches across the cutout. The fasteners are arranged to engage the hat at both the adjustment strap and the inner edge portion.

DETAILED DESCRIPTION

Figure 1:
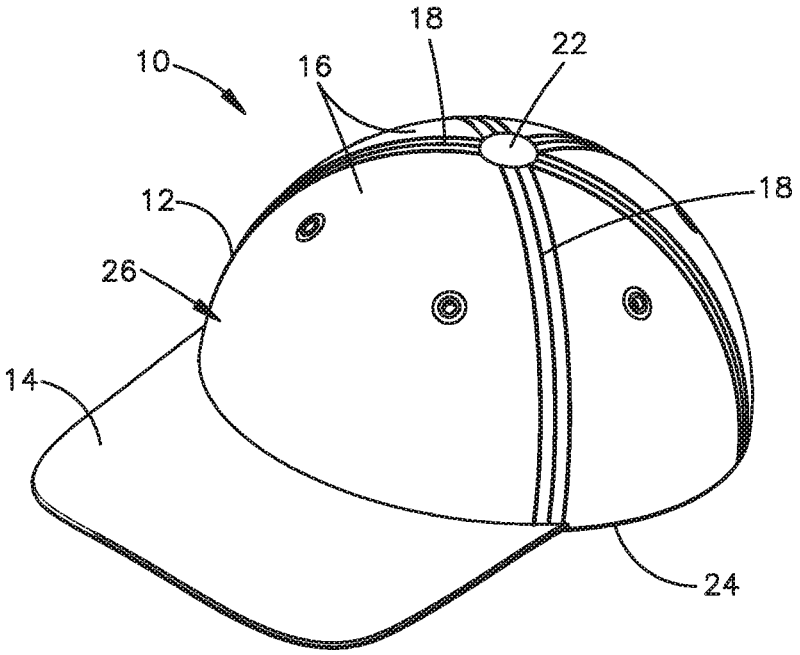
FIG. 1 is a front perspective view of a hat.

The embodiments illustrated in the drawings have parts that are examples of the elements recited in the claims. The illustrated embodiments thus include examples of how a person of ordinary skill in the art can make and use the claimed invention. They are described here to meet the enablement and best mode requirements of the patent statute without imposing limitations that are not recited in the claims. One or more of the elements of one embodiment may be used in combination with, or as a substitute for, one or more elements of another as needed for any particular implementation of the invention.

As shown in FIG. 1, a hat 10 is configured as a cap with a crown 12 and a brim 14. The crown 12 is formed of fabric panels 16 that are interconnected along stitched seams 18. The panels 16 converge at a top button 22, and together define a lower edge 24 of the crown 12. The brim 14 projects from the lower edge 24 at a front portion 26 of the crown 12.

Figure 2:
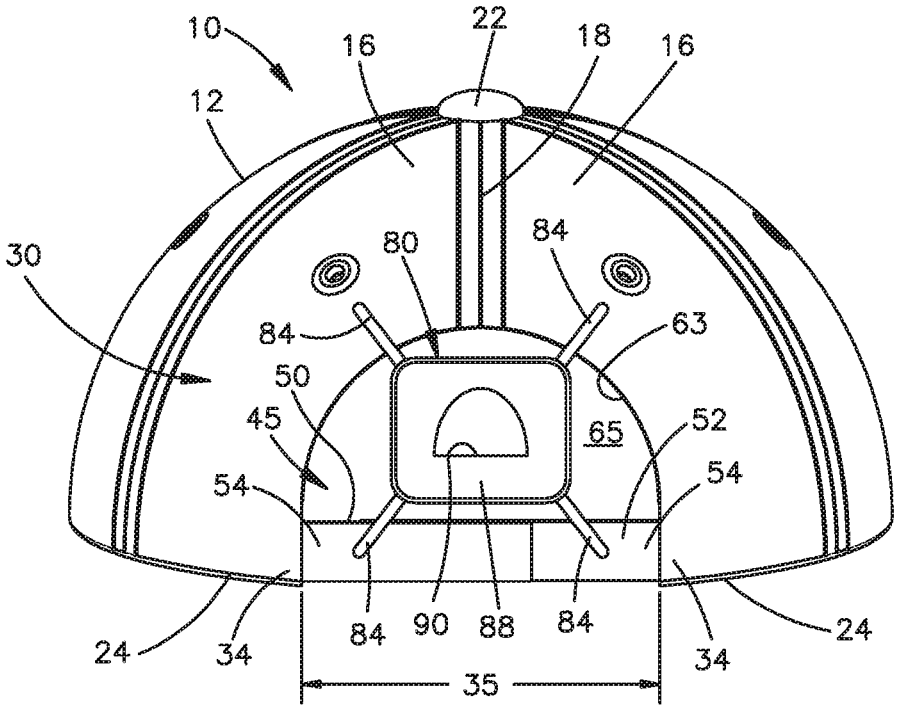
FIG. 2 is a rear view of the hat of FIG. 1, showing a wearable device mounted on the hat.

As shown in FIG. 2, a rear portion 30 of the crown 12 has a pair of corners 34. The lower edge 24 is discontinuous across a gap 35 between the corners 34. An inner edge portion 40 of the crown 12 reaches between the corners 34 in a U-shape defining a cutout 45 extending upward from the gap 35. An adjustment strap 50 reaches across the gap 35 between the corners 34 at the bottom of the cutout 45. An adjustable fitting 52, which may comprise any suitable device known in the art, interconnects sections 54 of the strap 50 for adjustable sizing of the gap 35 and the cutout 45. In this configuration, the adjustment strap 50 and the inner edge portion 40 of the crown 12 together define a continuous periphery 63 of an opening 65 in the hat 10.

Also shown in FIG. 2 is a wearable device 80 with fasteners 84. The device 80 has utility separately from the hat 10. The fasteners 84 are arranged to fasten the device 80 to the hat 10 at multiple locations spaced apart about the periphery 63 of the opening 65, and thereby to support the device 80 in a mounted position over the opening 65.

Figure 3:
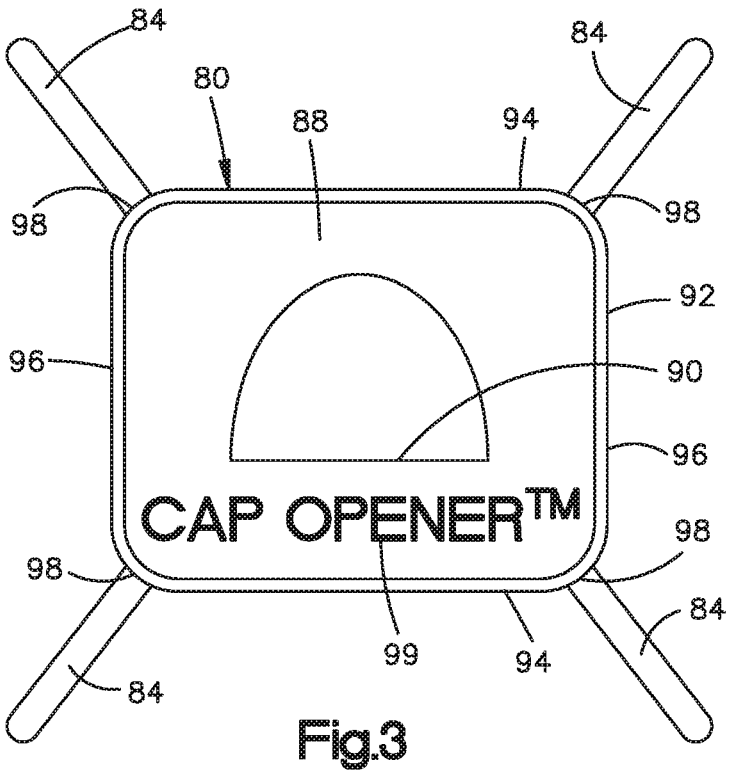
FIG. 3 is a view of the device of FIG. 2.

The device 80 of FIG. 2 is shown separately in FIG. 3. In this embodiment, the device 80 is a plate 88 with an inner edge 90 imparting the configuration of a bottle opener. A peripheral edge 92 provides the plate 88 with a generally rectangular shape having opposite sides 94, opposite ends 96, and rounded corners 98. The peripheral edge 92 also provides the device 80 with a peripheral size that is smaller than the periphery 63 of the opening 65. Graphics 99 such as a trademark or the like may also be provided on the device 80.

The fasteners 84 in this embodiment are fixed to the device 80. They include a pair of upper fasteners 84 projecting upward and oppositely outward from upper corners 98 of the plate 90, and a pair of lower fasteners 84 projecting downward and oppositely outward from lower corners 98 of the plate 90.

Figure 4:
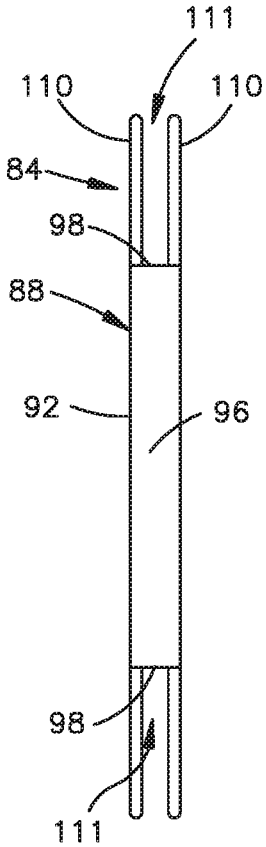
FIG. 4 is a side view of the device of FIG. 3.

As shown in FIG. 4, each fastener 84 in this embodiment is a pair of elongated, flexible prongs 110 in an overlying relationship defining a slot 111 therebetween. The slots 111 are open at their opposite sides along the lengths of the prongs 110, and also at their outer ends. Each slot 111 is thus configured to receive either the strap 50 or the inner edge portion 40 of the crown 12 in secure but releasable engagement between the prongs 110. This enables the fasteners 84 to support the device 80 on the hat 10 in a mounted position over the opening 65 as shown, for example in FIG. 2. Since the device 80 in this example is smaller than the opening 65, it fits within the opening 65 in the mounted position.

Further regarding the embodiment of FIGS. 2-4, the fasteners 84 are alike so that any adjacent pair of the fasteners 84 can engage the hat 10 at either the mounting strap 50 or the inner edge portion 40 of the crown 12. This enables the device 80 to be mounted in the position shown in FIG. 2, or in alternative positions rotated or inverted from that position. Additionally, the length of each fastener 84 is preferably limited relative to the width of the adjustment strap 50 to ensure that the fasteners 84 extend only partially across the strap 50 and do not project downward beyond the strap 50.

Figure 5:
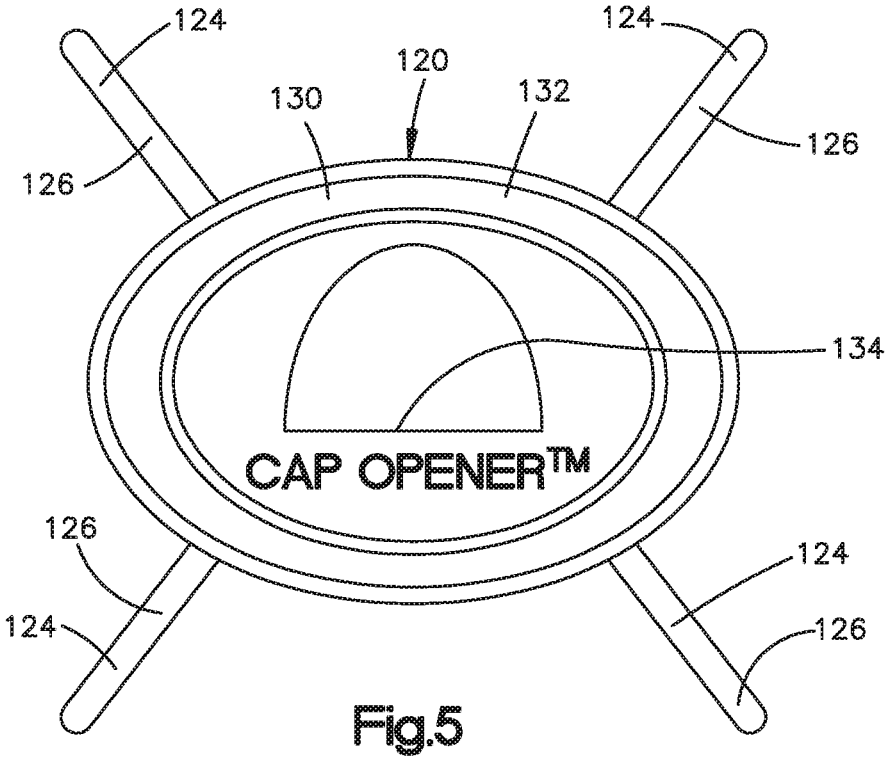
FIG. 5-16 are views of alternative wearable devices.

An alternative embodiment of a wearable device 120 with fasteners 124 is configured as shown in FIG. 5. The fasteners 124 in this embodiment are configured as pairs of prongs 126 having the same structure and function as the prongs 110 in the first embodiment, and likewise include a pair of upper fasteners 124 along with a pair of lower fasteners 124. Like the device 80 in the first embodiment, this device 120 also is a plate 132 with an inner edge 134 imparting the configuration of a bottle opener. However, this plate 132 has an oval rather than a rectangular shape.

Figure 6:
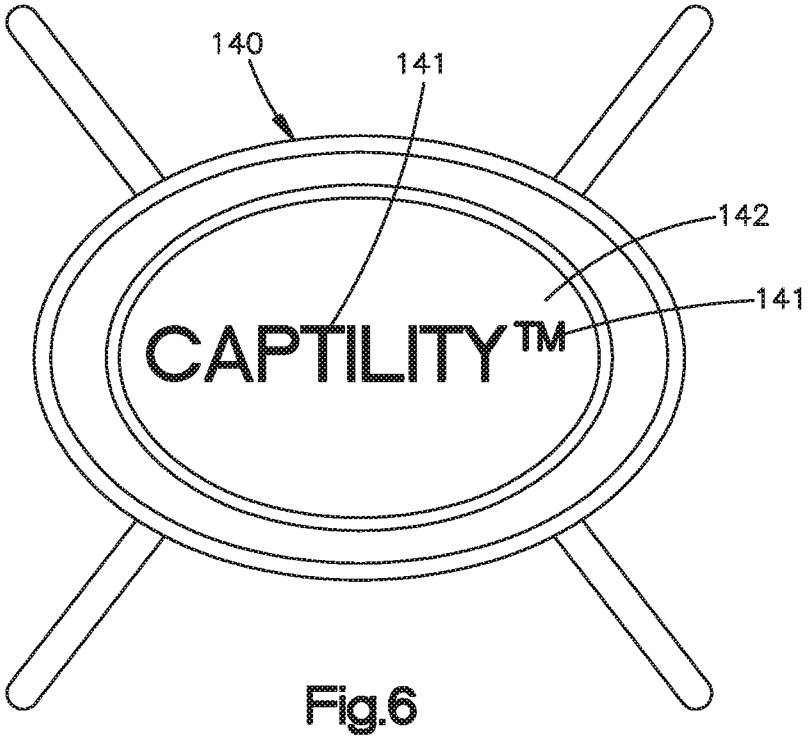

The device 140 of FIG. 6 differs from the embodiment of FIG. 3 by omitting the bottle opener configuration, but also serves as an advertising device with graphics 141 including a trademark. The device 140 further includes an electronic device 142 comprising a flashing light.

Figure 7:
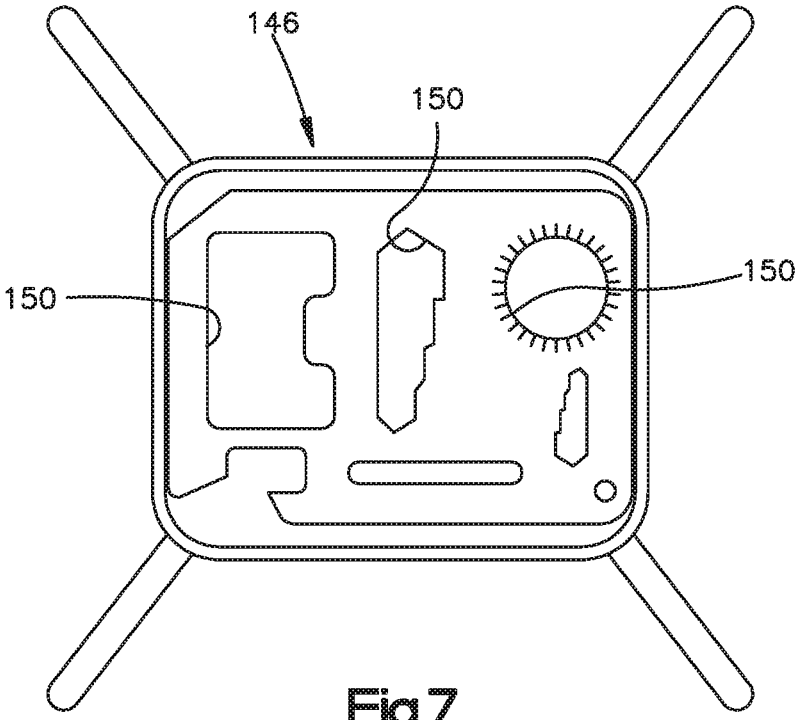
Figure 8:
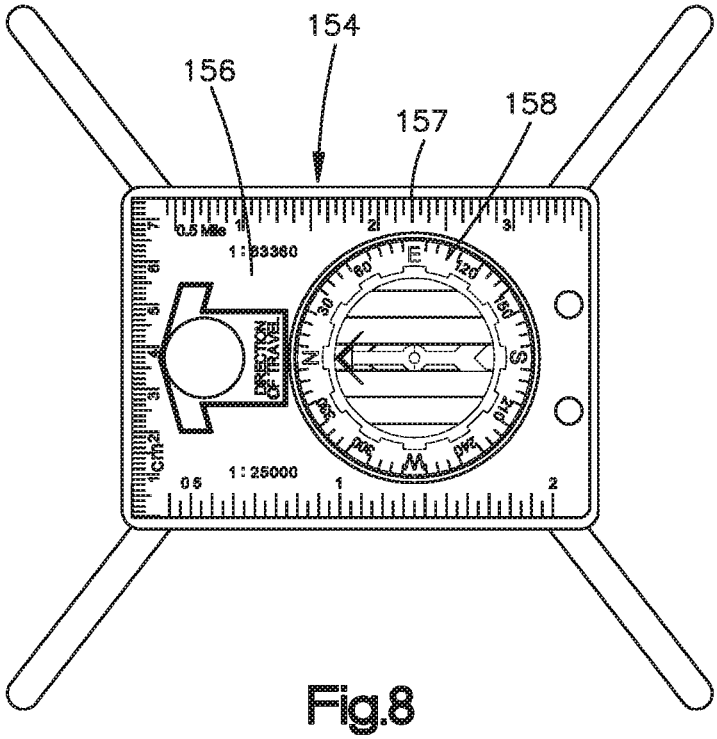
Figure 9:
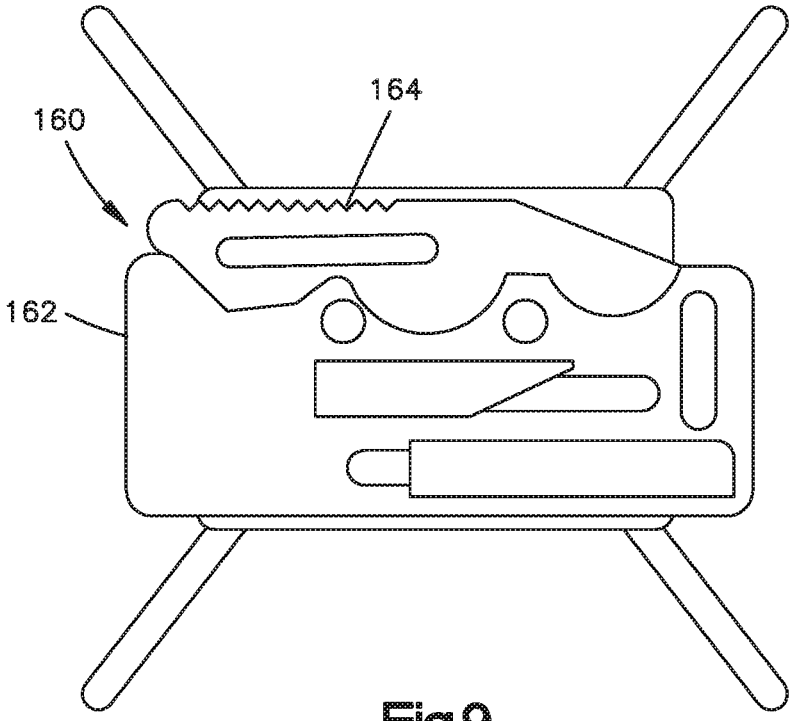
Figure 10:
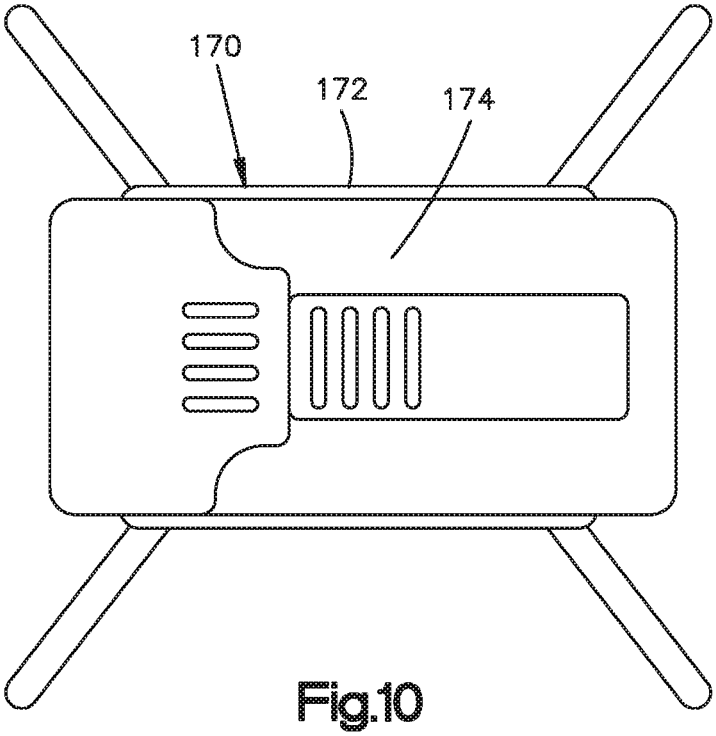

The device 146 of FIG. 7 differs from the embodiment of FIG. 3 by including multiple inner edges 150, each of which imparts the configuration of a manual tool. In the embodiment of FIG. 8, the device 154 includes a plate 156 that is substantially like the plate 88 of FIG. 3, but also omits the bottle opener configuration. In this embodiment the plate 156 bears graphic indicia 157 related to a compass 158 that is fixed to the plate 156 as part of the device 154. In a similar arrangement, the device 160 of FIG. 9 includes a plate 162 upon which a knife 164 is fixed as part of the device 160. The device 170 of FIG. 10 includes a plate 172 upon which a lighter 174 is fixed as part of the device 170.

Figure 11:
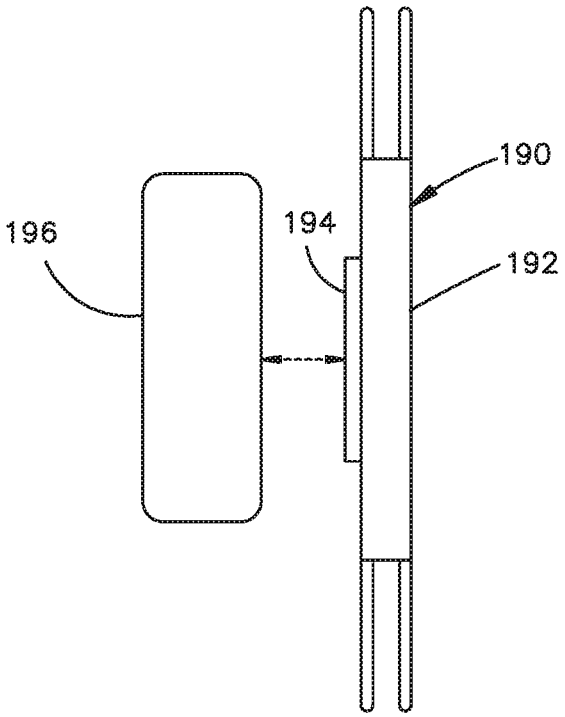
Figure 12:
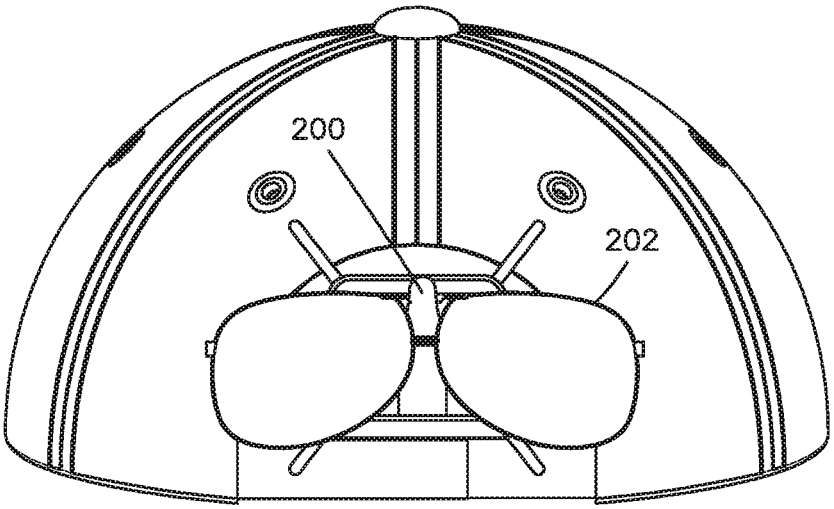

In the embodiment of FIG. 11, the device 190 includes a plate 192 and an attachment means 194 (shown schematically) that is fixed to the plate 192 as a permanent part of the device 190. The attachment means 194 enables attachment of a releasable part 196 of the device (also shown schematically), such as a manual tool, electronic device, compass, lighter, eyeglasses, or the like. Such an attachment means 194 may comprise a clip, magnet, hook-and-loop fasteners, or any other suitable attachment structure. For example, the attachment structure 200 shown in FIG. 12 is a clip for sunglasses 202.

Figure 13:
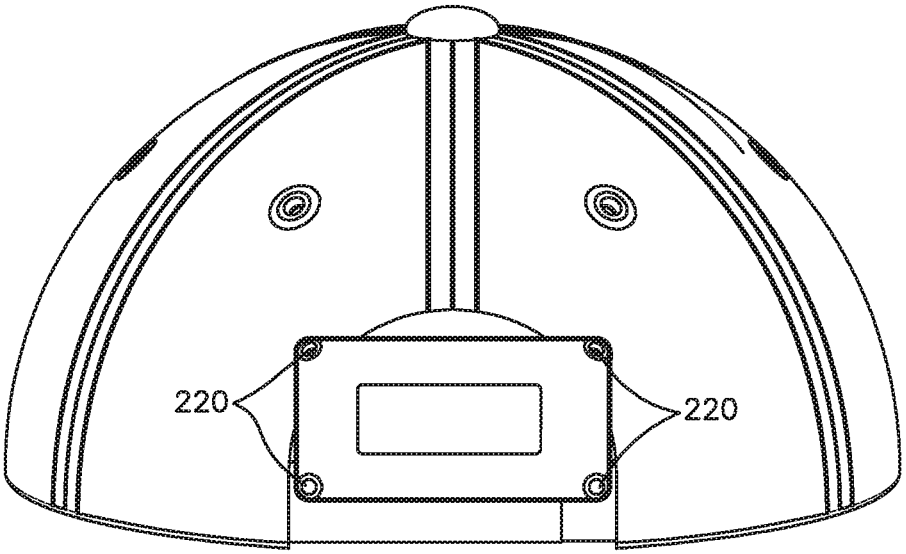
Figure 14:
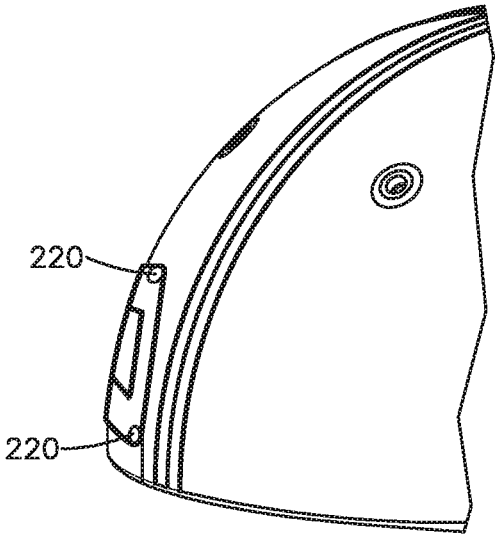
Figure 15:
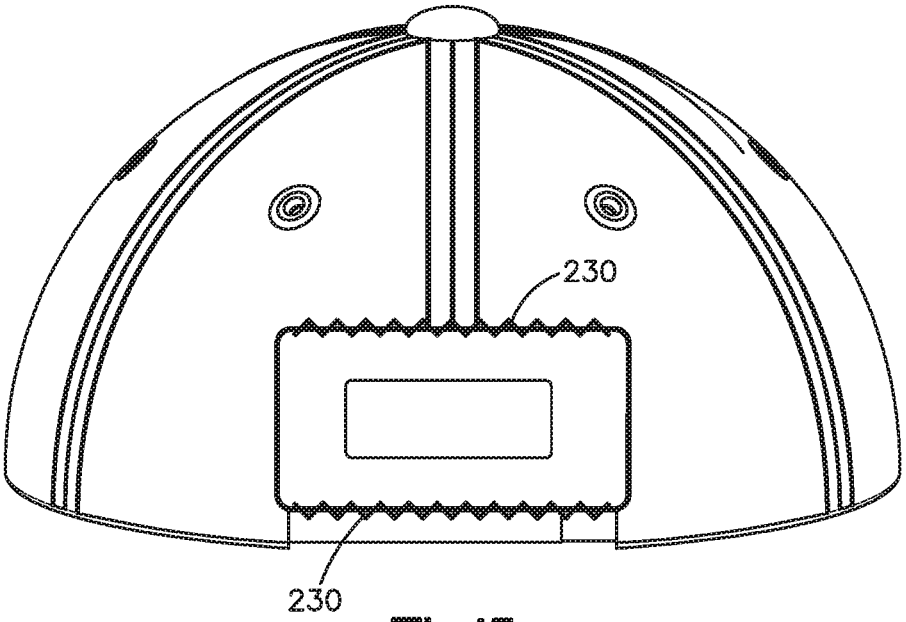
Figure 16:
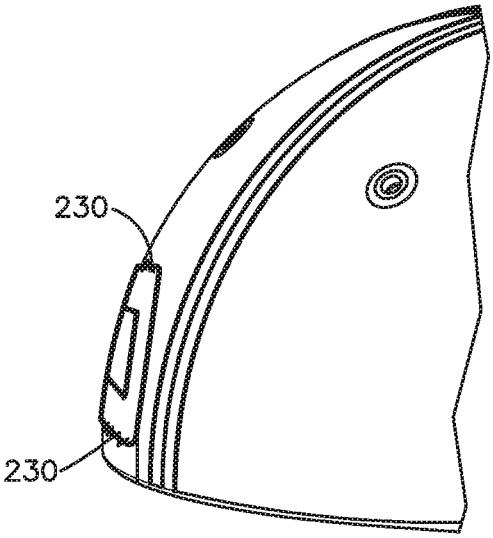

In other embodiments, the devices may be permanently affixed to the hats. The fasteners may be rivets 220 as shown for example in FIGS. 13 and 14, stitches 230 as shown for example in FIGS. 15 and 16, or any other suitable structures for permanently affixing a device over the cutout opening in a hat.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

What is claimed is:

1. An apparatus comprising:

a hat having an opening, a rear portion with a pair of corners, an inner edge portion reaching around the opening between the corners, and an adjustment strap reaching below the opening between the corners; and a device having utility separately from the hat, wherein the device has a periphery smaller than the opening in the hat so as to fit within the opening;

an upper fastener that is fixed to the device, wherein the upper fastener projects upward and away from the periphery of the device, and is configured to fasten the device to the hat at the inner edge portion of the hat; and a lower fastener that is fixed to the device, wherein the lower fastener projects downward and away from the periphery of the device, and is configured to fasten the device to the hat at the adjustment strap.

2. The apparatus as defined in claim 1, wherein the upper fastener is one of a pair of upper fasteners that are fixed to the device, wherein the upper fasteners project upward and away from the periphery of the device, and are configured to fasten the device to the hat at a pair of spaced-apart locations along the inner edge portion of the hat.

3. The apparatus as defined in claim 1, wherein the lower fastener is one of a pair of lower fasteners that are fixed to the device, wherein the lower fasteners project downward and away from the periphery of the device, and are configured to fasten the device to the hat at a pair of spaced-apart locations along the adjustment strap.

4. The apparatus as defined in claim 1, wherein the upper and lower fasteners are alike, whereby the device can be fastened to the hat in alternative positions that are rotated or inverted from each other within the opening in the hat.

5. The apparatus as defined in claim 4, wherein each of the upper and lower fasteners comprises a pair of elongated prongs in an overlying relationship defining a slot between the prongs, wherein the slot is open at opposite sides along the lengths of the prongs, and is open at outer ends of the prongs.

6. The apparatus as defined in claim 1, wherein the upper fastener is one of a pair of upper fasteners that are fixed to the device, wherein the upper fasteners project upward and away from the periphery of the device, and are configured to fasten the device to the hat at a pair of spaced-apart locations along the inner edge portion of the hat, and the lower fastener is one of a pair of lower fasteners that are fixed to the device, wherein the lower fasteners project downward and away from the periphery of the device, and are configured to fasten the device to the hat at a pair of spaced-apart locations along the adjustment strap.

7. The apparatus as defined in claim 6, wherein each of the upper and lower fasteners comprises a pair of elongated prongs in an overlying relationship defining a slot between the prongs, wherein the slot is open at opposite sides along the lengths of the prongs, and is open at outer ends of the prongs, the prongs at the upper fasteners project upward and diverge outwardly from the periphery of the device, and the prongs at the lower fasteners project downward and diverge outwardly from the periphery of the device.

8. The apparatus as defined in claim 1, wherein the device comprises a manual tool.

9. The apparatus as defined in claim 8, wherein the manual tool comprises a bottle opener.

10. The apparatus as defined in claim 8, wherein the manual tool comprises a knife.

11. The apparatus as defined in claim 1 wherein the device comprises an advertising item.

12. The apparatus as defined in claim 11, wherein the advertising item comprises graphics.

13. The apparatus as defined in claim 12, wherein the graphics comprise a trademark.

14. The apparatus as defined in claim 1, wherein the device comprises an electronic device.

15. The apparatus as defined in claim 1, wherein the device comprises a compass.

16. The apparatus as defined in claim 1, wherein the device comprises a lighter.

17. The apparatus as defined in claim 1, wherein the device comprises eyeglasses.

18. An apparatus comprising:

a hat having an opening, a rear portion with a pair of corners, an inner edge portion reaching around the opening between the corners, and an adjustment strap reaching beneath the opening between the corners;

a device comprising a bottle opener, wherein the device has a periphery smaller than the opening in the hat so as to fit within the opening;

a pair of upper fasteners that are fixed to the device, wherein the upper fasteners project upward and away from the periphery of the device, and are configured to fasten the device to the hat at a pair of spaced-apart locations along the inner edge portion of the hat; and a pair of lower fasteners that are fixed to the device, wherein the lower fasteners project downward and away from the periphery of the device, and are configured to fasten the device to the hat at a pair of spaced-apart locations along the adjustment strap.

19. The apparatus as defined in claim 18, wherein the upper and lower fasteners are alike, whereby the device can be fastened to the hat in alternative positions that are rotated or inverted from each other within the opening in the hat.

20. The apparatus as defined in claim 18, wherein the upper fasteners are elongated and diverge outwardly from the periphery of the device, and the lower fasteners are elongated and diverge outwardly from the periphery of the device.

21. The apparatus as defined in claim 18, wherein each of the upper and lower fasteners comprises a pair of elongated prongs in an overlying relationship defining a slot between the prongs, wherein the slot is open at opposite sides along the lengths of the prongs, and is open at outer ends of the prongs, the prongs at the upper fasteners project upward and diverge outwardly from the periphery of the device, and the prongs at the lower fasteners project downward and diverge outwardly from the periphery of the device.

* * * * *